US011577108B2

(12) United States Patent
Thompson et al.

(10) Patent No.: US 11,577,108 B2
(45) Date of Patent: Feb. 14, 2023

(54) DRY SPRINKLER ASSEMBLIES FOR FIRE PROTECTION SPRINKLER SYSTEMS

(71) Applicant: Minimax Viking Research & Development GmbH, Bad Oldesloe (DE)

(72) Inventors: Andrew T. Thompson, Hastings, MI (US); Gary William Pleyte, Hastings, MI (US); Sylvain Coupal, Saint-Jérôme (CA)

(73) Assignee: Minimax Viking Research & Development GmbH, Bad Oldesloe (DE)

( * ) Notice: Subject to any disclaimer, the term of this patent is extended or adjusted under 35 U.S.C. 154(b) by 0 days.

(21) Appl. No.: 17/765,341

(22) PCT Filed: Oct. 18, 2020

(86) PCT No.: PCT/US2020/056212

§ 371 (c)(1),
(2) Date: Mar. 30, 2022

(87) PCT Pub. No.: WO2021/077060

PCT Pub. Date: Apr. 22, 2021

(65) Prior Publication Data

US 2022/0347504 A1 Nov. 3, 2022

Related U.S. Application Data

(60) Provisional application No. 62/916,630, filed on Oct. 17, 2019, provisional application No. 62/959,676, filed on Jan. 10, 2020.

(51) Int. Cl.
*A62C 35/62* (2006.01)
*A62C 37/14* (2006.01)
(Continued)

(52) U.S. Cl.
CPC ..... *A62C 35/62* (2013.01); *A62C 35/68* (2013.01); *A62C 37/12* (2013.01); *A62C 37/14* (2013.01)

(58) Field of Classification Search
CPC ..... A62C 3/004; A62C 35/62; A62C 35/68; A62C 37/12; A62C 37/14
See application file for complete search history.

(56) References Cited

U.S. PATENT DOCUMENTS 5,188,185 A * 2/1993 Mears ..... A62C 37/09 169/37
5,775,431 A * 7/1998 Ondracek ..... A62C 37/14 169/37

(Continued)

OTHER PUBLICATIONS

International Searching Authority, International Search Report and Written Opinion in International Appln. No. PCT/US2020/056212, dated Jan. 21, 2021, 16 pages.

*Primary Examiner* — Darren W Gorman
(74) *Attorney, Agent, or Firm* — Perkins Coie LLP

(57) ABSTRACT

An automatic fire protection sprinkler assembly for fire protection systems that includes a tubular outer housing having an inlet, an outlet opening and an internal shelf proximate the outlet opening. A fluid deflection member is spaced from the outlet opening along a fluid flow path of the assembly. A fluid control assembly is disposed within the outer housing for axial translation from an unactuated state to an actuated state of the sprinkler assembly. The fluid control assembly includes a seal subassembly, a fluid flow tube; and an ejectable support subassembly. The support subassembly includes a projection member. Upon actuation of a thermally responsive trigger, the support subassembly is ejected out the outlet opening such that the projection
(Continued)

member comes into contact with the internal shelf of the housing to pivot the support subassembly out of the fluid flow path.

25 Claims, 9 Drawing Sheets

(51) Int. Cl.
*A62C 37/12* (2006.01)
*A62C 35/68* (2006.01)

(56) References Cited

U.S. PATENT DOCUMENTS

| | | | | |
|---|---|---|---|---|
| 7,516,800 | B1 * | 4/2009 | Silva, Jr | A62C 35/62 169/17 |
| 7,766,252 | B2 | 8/2010 | Jackson et al. | |
| 8,636,075 | B2 | 1/2014 | Franson et al. | |
| 9,993,675 | B2 * | 6/2018 | Groen | A62C 37/14 |
| 10,099,080 | B2 * | 10/2018 | Miller | A62C 35/62 |
| 2008/0257564 | A1 * | 10/2008 | Cordell | A62C 35/62 169/17 |
| 2011/0000685 | A1 | 1/2011 | Matsuoka | |
| 2012/0186832 | A1 * | 7/2012 | Orr | A62C 35/00 169/37 |
| 2017/0056697 | A1 | 3/2017 | Silva, Jr. | |
| 2019/0240519 | A1 * | 8/2019 | Archibald | A62C 37/42 |
| 2020/0061401 | A1 * | 2/2020 | Pechacek | A62C 37/11 |

* cited by examiner

DRY SPRINKLER ASSEMBLIES FOR FIRE PROTECTION SPRINKLER SYSTEMS

Priority Claim & Incorporation By Reference

This application is a 35 U.S.C. §371 application of International Application No. PCT/US2020/056212, filed Oct. 18, 2020, which claims the benefit of U.S. Provisional Application No. 62/916,630 filed Oct. 17, 2019 and U.S. Provisional Application No. 62/957,676 filed Jan. 6, 2020, each of which is incorporated by reference in its entirety.

Technical Field

The present invention relates generally to dry sprinkler assemblies.

Background Art

Automatic fire protection sprinkler systems can be configured as a wet system in which automatic fire protection sprinklers are attached to a piping system filled with a fire fighting fluid, such as water, under a sufficient pressure for sprinkler operation. Alternatively, the sprinkler system can be configured as a dry pipe sprinkler system in which the automatic fire protection sprinklers are attached to a piping system containing air or nitrogen under pressure, the release of which permits water pressure to open a fluid control valve thereby letting water fill the piping system and flow out of any actuated and open sprinklers. Dry pipe fire protection sprinkler systems are known in the industry and utilized in applications wherein it is disadvantageous to have water or other fire extinguishing fluid residing within the fluid supply lines of the fire extinguishing system when the sprinkler system is not activated. One specific application in which dry pipe sprinkler systems are used include warehouses and other commercial environments wherein the temperature is low enough to cause freezing of the fluid within the pipes. One type of dry sprinkler system is a vacuum dry sprinkler system in which automatic fire protection sprinklers are interconnected by a network of firefighting fluid supply pipes that are subject to a vacuum or negative pressure below atmospheric pressure in the unactuated standby state of the system. In operation, one or more sprinklers of the system thermally actuate in response to a fire thereby exposing the actuated sprinklers and supply pipes to a positive pressure at or above atmospheric pressure. The positive pressure in the piping activates a system control assembly which subsequently releases the firefighting fluid under pressure into the supply piping. The firefighting fluid fills the pipes and is subsequently expelled from the actuated sprinklers to address the fire. An example of a vacuum dry fire sprinkler system is described in U.S. Pat. No. 6,715,561.

Generally, automatic fire protection sprinklers include a sprinkler frame and/or housing having an inlet, an outlet and internal passageway through which firefighting fluid flows and discharged to impact a fluid deflection member that is coupled to the sprinkler frame and spaced from the outlet. Fluid flow through the sprinkler is controlled by a thermally responsive trigger which supports a sealing assembly in a position that seals the internal passageway of the sprinkler. Upon thermal actuation of the trigger in response to a fire, the trigger fractures or collapses thereby releasing the sealing assembly to allow the flow of fluid through the sprinkler internal passageway. U.S. Pat. No. 6,715,561 shows and describes one type of automatic fire protection sprinkler that is suitable for use in vacuum systems. The automatic fire protection sprinkler shown and described therein includes an open inlet and an ejectable sealing assembly that is seated within the outlet to seal the sprinkler. The sealing assembly is supported in place by a thermally responsive glass bulb trigger. Accordingly, in the unactuated state of the vacuum fire protection system, the inlet opening and internal passageway of the sprinkler is subject to a vacuum pressure. In an actuated thermal response to a fire, the glass bulb shatters and the sealing assembly is released from the outlet to expose the fluid supply pipes to atmospheric pressure and actuate the fluid supply control system for the delivery of firefighting fluid.

One problem in vacuum dry sprinkler systems is overcoming the vacuum pressure within the sprinkler once the thermally responsive trigger is actuated. When the trigger of a sprinkler actuates to unseal the sprinkler, the internal passageway is still subject to the vacuum pressure of the supply lines which can prevent or inhibit movement of the sealing assembly to completely open the sprinkler. If the vacuum pressure holds the ejectable components of the sprinkler within the frame, the sprinkler may not fully open which inhibits the flow of positive or atmospheric pressure into the supply lines. The vacuum pressure therefore is maintained within the supply lines which prevents operation of the system control assembly and the flow of firefighting fluid into the supply piping. To facilitate complete ejection of the seal assembly in the sprinkler of U.S. Pat. No. 6,715,561, an external spring acts on the ejectable component to laterally displace the seal assembly out of frame and the fluid flow path after actuation of the glass bulb trigger. By fully opening the sprinkler, atmospheric pressure can enter the fluid supply pipes to actuate the fluid supply control system for the delivery of firefighting fluid.

Another type of automatic fire protection sprinkler is the automatic dry sprinkler. A dry sprinkler assembly generally includes a tubular sprinkler housing with an inlet end fluid opening and a discharge outlet opening axially spaced from the inlet opening with an internal passageway extending therebetween. An internal seal assembly is supported within the housing between the inlet and outlet openings by a frangible thermally responsive glass bulb trigger to seal the sprinkler at the fluid inlet. When the bulb fractures in response to a fire, a component of the seal assembly is ejected from the outlet of the housing allowing the remainder of the internal seal assembly to axially translate out of its sealed position thereby opening the fluid inlet and sprinkler internal passageway. An example of a dry sprinkler is shown in U.S. Pat. No. 8,636,075.

It is believed that known dry sprinklers are not currently used in dry vacuum fire protection systems because the structure of these known dry sprinkler present problems in overcoming the vacuum pressure upon trigger actuation. More particularly, it is believed that the vacuum pressure can hold the ejectable components of the internal sealing assembly within the housing such that the remainder of the sealing assembly cannot translate out of its seal position at the fluid inlet to fully open the sprinkler which would inhibit the flow of positive or atmospheric pressure into the supply lines, operation of the system control assembly and the flow of firefighting fluid into the supply piping. Another problem that may be experienced with dry sprinklers generally is an issue of lodgment. Once expelled from the outlet, the ejectable component of the internal sealing assembly can bounce off the fluid deflection member or surrounding housing structure of the sprinkler and can be deflected back towards the orifice outlet and lodged in the fluid flow path between the outlet and the fluid deflection member. This lodgment can inhibit the full translation of the remainder of the internal seal assembly and the opening of the sprinkler if vacuum pressure is still present in the housing. Moreover, the lodged component can interfere with the proper discharge and distribution of the firefighting fluid.

The external spring used in the sprinkler of U.S. Pat. No. 6,715,561 does not present a solution that is compatible with known ejectable components of the known dry automatic sprinklers, such as that of U.S. Pat. No. 8,636,075. Accordingly, there remains a need for a variety of dry sprinkler assembly configurations that can be used in wet and dry sprinkler systems that facilitates complete and proper operation of the actuated sprinkler and system.

Disclosure of Invention

Preferred embodiments of an automatic dry fire protection sprinkler assembly are provided for use in fire protection sprinkler systems. The preferred sprinkler assembly generally includes an elongate tubular outer housing having a first end and a second end opposite the first end. Within the tubular housing, an internal conduit extends from the first end to the second end along a longitudinal sprinkler axis. The first end of the housing defines a fluid intake end of the sprinkler assembly having an inlet opening and an internal sealing surface proximate the inlet opening. The second end of the housing defines a fluid discharge end of the sprinkler assembly having an outlet opening and a preferred internal contact surface in the form of a shelf formed internally proximate the outlet opening. A fluid deflection member is preferably coupled to the housing to locate the fluid deflection member at a preferably fixed distance from the outlet opening defining a fluid flow path between the deflection member and the outlet opening.

The sprinkler is an automatic sprinkler in which fluid flow through the sprinkler is regulated by a thermally responsive trigger assembly and a preferred internal fluid control assembly disposed within the housing. The trigger defines an unactuated state of the sprinkler assembly in which the trigger supports the internal fluid control assembly within the housing to form a fluid-tight seal with the internal sealing surface. Upon thermal operation of the trigger, an actuated state of the sprinkler assembly is defined in which the internal fluid control assembly axially translates out of contact with the internal sealing surface.

The preferred fluid control assembly includes an ejectable member that is ejected out the outlet opening and displaced out of the fluid flow path between the housing and the fluid deflection member. In the preferred sprinkler assembly, a preferred structural and dynamic relationship between the ejectable member and the housing ensures proper and complete ejection of the ejectable member. More specifically, upon thermal actuation of the trigger, the sprinkler assembly forms a surface contact between the ejectable member and the internal shelf. The surface contact causes the ejectable member to pivot out of the fluid flow path after its ejection from the outlet opening. Accordingly, the preferred structural and dynamic relationship between the ejectable member and the housing define a spatial and temporal coordination between the axial translation of the ejectable member and its pivot out of the fluid flow path.

In one preferred embodiment of a dry sprinkler assembly, a tubular outer housing has one end forming an inlet end of the sprinkler assembly and an opposite end of the housing forming an outlet end of the sprinkler assembly. A preferably continuous internal conduit extends between the inlet end and the outlet end to house an internal fluid control assembly that controls the flow of fluid therethrough. The fluid control assembly includes a seal subassembly located within the inlet end, a preferred ejectable support subassembly located within the outlet end, and a fluid flow tube that interconnects the seal and support subassemblies. In an unactuated state of the sprinkler assembly, the support subassembly of the internal fluid control assembly is seated against a thermally responsive trigger so that the seal subassembly of the fluid control assembly forms a sealed engagement within the inlet end of the housing. Upon thermal actuation of the trigger, the fluid control assembly axially translates with the support subassembly translating out of the outlet opening and the seal subassembly translating out of its sealed engagement. Preferred embodiments of the support subassembly include a projection member that, in the unactuated state of the sprinkler assembly, defines an axial spacing between the projection member and the internal shelf of the housing formed proximate the outlet opening of the housing.

Upon thermal actuation of the trigger, the support subassembly axially translates such that the projection member is brought into contact with and impacts the internal shelf. The impact imparts a rotation upon the support subassembly out of the flow path of the fluid assembly. In preferred embodiments of the sprinkler assembly, a portion of the support subassembly is ejected out of the outlet end of the housing in line with the sprinkler axis upon the thermal actuation of the trigger. The contact of the projection member with the internal shelf alters the orientation of the support subassembly to be skewed with respect to the sprinkler axis.

A preferred ejectable support subassembly of the fluid control assembly includes a post member having a first end and a second end axially spaced from the first end with a radially extending projection member interlocked about the post member between the first and second ends. In the unactuated state of the sprinkler assembly, the support subassembly is seated against the thermally responsive trigger to locate the fluid flow assembly within the outer housing of the sprinkler assembly to form the fluid-tight sealed engagement with the internal sealing surface of the housing. The projection member is interlocked with the post member to define the preferred axial spacing between the projection member and the internal shelf of the housing. In a preferred embodiment, the projection member forms a press-fit engagement with the post member. Alternatively or additionally, preferred embodiments of the support subassembly includes an indicator formation on a visible surface of the post member that is located relative to the post member to indicate the orientation of the projection member within the outer housing. In one preferred embodiment, an elongated slot is formed on the visible end of the post member. The elongated slot extends in a direction perpendicular to the radial direction of the projection member. In a preferred sprinkler assembly in which the outer housing includes a pair of frame arms formed about the outlet opening, the elongated slot is aligned in the plane of the frame arms to locate the projection member of the ejectable support subassembly and its pivot in a plane bisecting the frame arms.

Preferred embodiments of the housing include a body at the outlet end of the housing having an internal surface that extends axially and radially to surround the sprinkler axis and define an internal radius of the body to facilitate the preferred structural and dynamic relationship between the housing and the preferred support subassembly. The internal surface is preferably contiguous with the internal shelf, which is contacted by the projection member of the support subassembly upon actuation of the thermally responsive trigger. In preferred embodiments, the internal surface of the body defines a radius about the sprinkler axis that accommodates the projection member of the support subassembly to be axially located in line with the internal shelf, at a preferably overlapping axially spaced distance, that allows for the axial translation of the projection member toward the internal shelf. In one preferred embodiment, the internal surface of the body has a variable radius to define a recessed region that accommodates the projection member of the support subassembly to axially locate the projection member in line with the internal shelf allowing for the axial translation of the projection member toward the contact surface. In an alternate preferred embodiment, the internal surface of the body has a constant radius about the sprinkler axis to define an annular recess for accommodating the projection member.

The preferred sprinklers provide methods of actuating an automatic dry sprinkler. The preferred methods locating a projection member of the ejectable support subassembly at an overlapping axially spaced distance from an internal shelf of the outer housing in the unactuated state of the trigger; and placing the projection member in contact with the internal shelf of the housing in the actuated state of the trigger.

Sprinkler assemblies incorporating the preferred structural and dynamic relationship between the ejectable member and the housing provide for preferred sprinkler assemblies that can be used in dry vacuum fire protection systems and methods. One preferred method includes obtaining a dry sprinkler assembly having a tubular outer housing having an internal conduit with a fluid control assembly is disposed coaxially within the internal conduit of the outer housing for axial translation from an unactuated state to an actuated state of the sprinkler. The preferred method further includes providing the dry sprinkler for installation in a dry vacuum fire protection system. In the actuated state of the sprinkler, the fluid control assembly includes an ejectable support subassembly having axially spaced from an internal shelf of the outer housing in the unactuated state of the sprinkler assembly. In the actuated state of the sprinkler assembly, the ejectable support subassembly is translated out of the housing to bring the projection member into contact with the internal shelf.

In a preferred embodiment of a dry vacuum fire protection system, the preferred system includes a network of pipes including a fluid supply riser and a branch pipe coupled to the fluid supply riser; an automatic fire protection sprinkler coupled to the branch pipe; and a vacuum pressure source coupled to the network of pipes to apply a negative pressure to the branch pipe and the fire protection sprinkler. The fire protection sprinkler is a dry sprinkler that includes: a tubular outer housing having a first end and a second end opposite the first end with an internal conduit extending from the first end to the second end along a longitudinal sprinkler axis. The first end of the housing defines a fluid intake end of the sprinkler assembly having an inlet opening and an internal sealing surface proximate the inlet opening. The second end of the housing defines a fluid discharge end of the sprinkler assembly having an outlet opening and an internal shelf formed about the outlet opening. A fluid deflection member is affixed to the tubular housing at a fixed distance from the outlet opening to define a fluid flow path therebetween and a thermally responsive trigger is seated at a fixed distance from the outlet opening between the fluid deflection member and the outlet opening to define an unactuated state of the sprinkler assembly. The thermal response of the trigger defines an actuated state of the sprinkler.

A preferred fluid control assembly is disposed coaxially within the internal conduit of the outer housing for axial translation in the thermal response from the unactuated state to the actuated state of the sprinkler assembly. The fluid control assembly preferably includes a seal subassembly; a fluid flow tube abutting the seal subassembly; and an ejectable support subassembly abutting the fluid flow tube. The support subassembly has a first end proximate the fluid flow tube and a second end axially spaced from the first end and proximate the outlet opening. The support subassembly including a projection member preferably located between the first and second ends of the support , the support subassembly being seated against the trigger to locate the fluid control assembly within the housing such that the seal subassembly is in fluid-tight sealed engagement with the internal sealing surface and the projection member is preferably axially spaced from and aligned with the internal shelf in the unactuated state of the sprinkler assembly. In the actuated state of the sprinkler assembly, the projection member contacts the internal shelf and the ejectable support subassembly is preferably pivoted out of the fluid flow path between the deflector and the outlet opening and the seal subassembly is axially translated out of contact with the internal sealing surface to place the internal conduit in fluid communication with the branch pipe under negative pressure.

BRIEF DESCRIPTION OF DRAWINGS

The accompanying drawings, which are incorporated herein and constitute part of this specification, illustrate exemplary embodiments of the invention, and together, with the general description given above and the detailed description given below, serve to explain the features of the invention. It should be understood that the preferred embodiments are some examples of the invention as provided by the appended claims.

Mode(s) For Carrying Out the Invention

Figure 1:
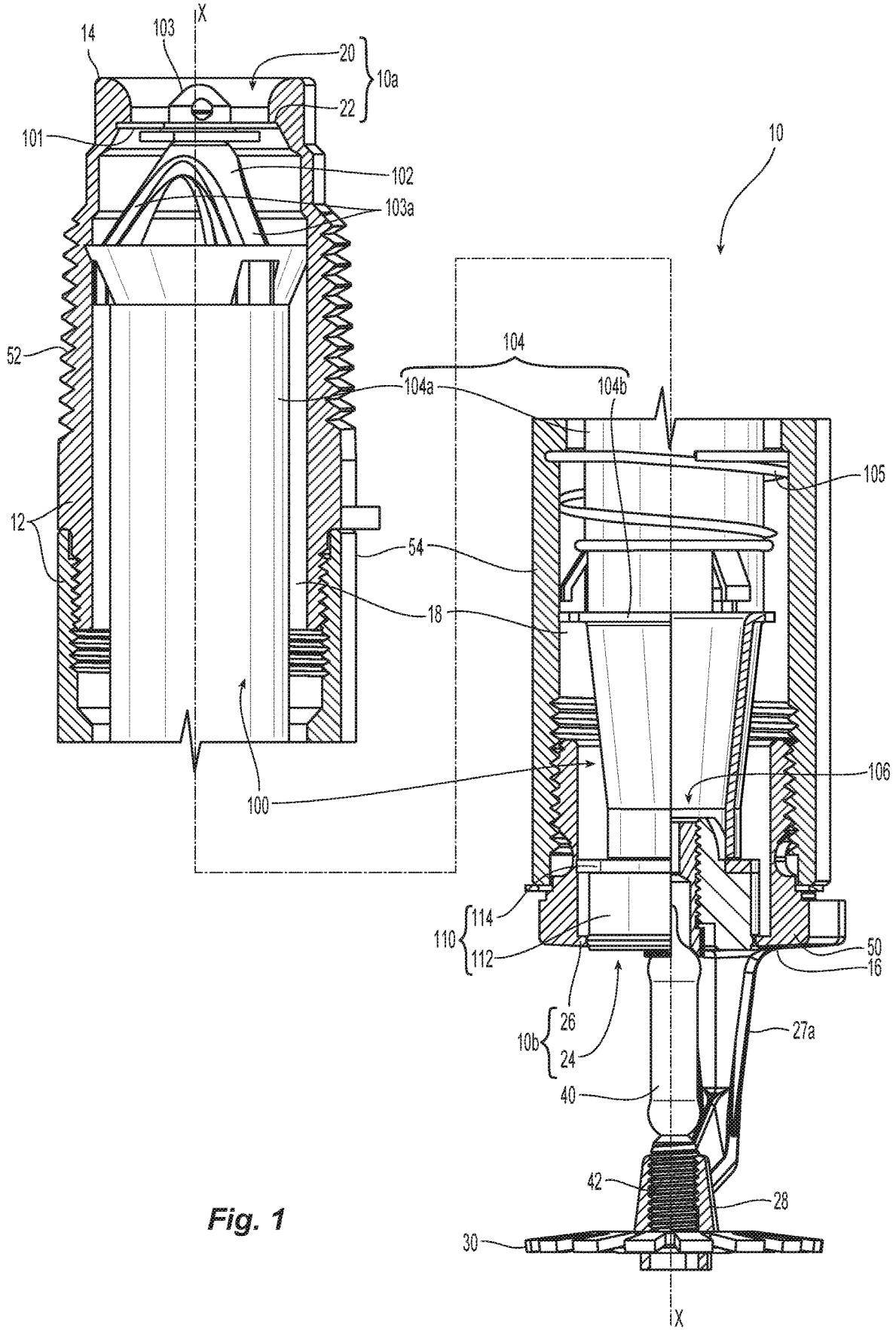
FIG. 1 is a cross-sectional view of a preferred embodiment of a dry sprinkler assembly.

Shown in FIG. 1 is a preferred embodiment of an automatic dry sprinkler assembly 10 for use in fire protection systems including dry pipe fire protection sprinkler systems and in particular, for use in vacuum dry fire protection sprinkler systems. The sprinkler assembly generally includes an elongate tubular outer housing 12 having a first end 14 and a second end 16 opposite the first end 14. Within the tubular housing 12, an internal conduit 18 extends from the first end 14 to the second end 16 along a longitudinal sprinkler axis X-X. The first end 14 of the housing 12 defines a fluid intake end 10*a* of the sprinkler assembly 10 having an inlet opening 20 and an internal sealing surface 22 proximate the inlet opening 20. The second end 16 of the housing 12 defines a fluid discharge end 10*b* of the sprinkler assembly 10 having an outlet opening 24 and a preferred internal contact surface in the form of a shelf 26 proximate the outlet opening 24. A fluid deflection member 30 is coupled to the housing 12 to locate the fluid deflection member 30 at a preferably fixed distance from the outlet opening 24 along a fluid flow path of the sprinkler assembly.

Installed in a fire protection system, the first end 14 of the sprinkler assembly 10 is coupled to a fluid supply pipe (not shown) or pipe fitting of the system. The sprinkler 10 is an automatic sprinkler in which fluid flow through the sprinkler is regulated by a thermally responsive trigger assembly 40, such as for example a thermally responsive glass bulb as shown, and a preferred internal fluid control assembly 100 disposed within the housing 12. The trigger 40 defines an unactuated state of the sprinkler assembly 10 in which the trigger 40 supports the internal fluid control assembly 100 within the housing 12 to form a fluid-tight seal with the internal sealing surface 22 to seal the rest of the sprinkler assembly from the negative vacuum pressure or other fluid within the supply pipe of the system. Upon thermal operation of the trigger 40, an actuated state of the sprinkler assembly 10 is defined in which the internal fluid control assembly 100 axially translates out of contact with the internal sealing surface 22 thereby placing the internal conduit 18 in fluid communication with the fluid supply pipe of the system. Depending on the fluid flowing in the supply pipe at the time of actuation, the internal conduit 18 may initially be subject to negative pressure, in the case of a dry vacuum system, or air in the case of a dry system, until water or another firefighting fluid fills the supply pipe and enters the internal conduit 18 of the housing 12 through the inlet opening 20. The water flows through the internal conduit 18 and through the internal fluid control assembly 100 and is discharged out of the control assembly 100 and/or the outlet opening 24 of the housing 12. The discharged fluid flows along the fluid flow path and impacts the fluid deflection member 30 for distribution about and below the sprinkler 10 to wet the surrounding area and address any fire in the immediate vicinity.

The fluid control assembly 100 includes an ejectable member that is translated out of the internal conduit 18 of the housing, ejected out the outlet opening 24 and displaced, and more preferably pivoted, out of the fluid flow path between the housing 12 and the fluid deflection member 30. As described above in the Background Section, one source of lodgment for known sprinklers preventing their proper operation is the surrounding sprinkler structure which can hold sealing components in the fluid flow path. In the preferred sprinkler assembly 10, a preferred structural and dynamic relationship between the ejectable member and the housing ensure proper and complete ejection and displacement of the ejectable member. More specifically, upon trigger actuation, the sprinkler assembly 10 forms a surface contact between the ejectable member of the fluid control assembly 100 and the preferred internal shelf 26 of the housing 12 after the ejectable member is sufficiently translated out of the outlet opening 24. The surface contact causes the ejectable member to pivot out of the fluid flow path after its ejection from the outlet opening 24. Accordingly, the preferred structural and dynamic relationship between the ejectable member and the housing define a spatial and temporal coordination between the axial translation of the ejectable member and its pivot out of the fluid flow path.

A preferred embodiment of the fluid control assembly 100 includes a seal subassembly 102 and a fluid flow tube 104 which forms a discharge orifice end 106 opposite the seal subassembly 102. Abutting the discharge orifice end 106 is a support subassembly 110 which forms the preferred ejectable member of the fluid control assembly 100. Generally, the ejectable support subassembly 110 includes a post member 112 having a first end 112*a* and a second end 112*b* spaced apart from one another defining an axial length L or height of the support subassembly 110. Moreover, in the preferred embodiment shown in FIG. 1, the first end 112*a* of the post member 112 is telescopically received within the discharge orifice end 106 with the remainder of the post member configured and dimensioned to support the discharge orifice end 106 and the fluid flow tube 104 in the unactuated state of the sprinkler assembly and eject out the outlet opening 24 in a manner as described herein.

Preferably located between the ends 112*a*, 112*b* of the post member is a projection member 114 that extends radially from the post member 112. More preferably, the projection member 114 is interlocked with the post member 112. As used herein, the "interlocked" relationship between the post member 112 and projection member 114 means a mechanical engagement between the two that affixes each component to the other so as to inhibit, and more preferably, prevent relative movement between the components. A preferred mechanical engagement between the two components is formed without the need for or reliance of a separate fastening component or material such as, for example, screw, pin, rivet, adhesive, solder or weld; however, a separate fastening component or material such as, for example, screw, pin, rivet, adhesive, solder or weld could be utilized to facilitate the mechanical engagement. One exemplary form of interlocked engagement between components includes an interference fit engagement. A preferred interference engagement between the post member 112 and the projection member 114 is a press-fit engagement in which one component is forced under pressure into a slightly smaller hole or opening in the other.

In the unactuated state of the sprinkler assembly 10, the support subassembly 110 is seated against the thermally responsive trigger 40 to locate the fluid flow assembly 100 within the housing 12 such that the post member 112 and the projection member 114 are located within the discharge end 10*b* of the housing 12 so as to locate the projection member 114 at a preferably overlapping axially spaced distance from the internal shelf 26 and with the seal subassembly 102 in a fluid-tight sealed engagement with the sealing surface 22 of the fluid intake end 10*a*. In the actuated state of the sprinkler 10 when the trigger 40 operates, the support subassembly 110 is axially displaced with the fluid flow tube 104 remaining in contact with the support subassembly 110 such that seal subassembly 102 axially translates out of contact with the sealing surface 22. The support subassembly 110 is then ejected out the internal conduit 18 through the outlet opening 24 such that the projection member 114 comes into contact with the internal shelf 26. The support subassembly 110 remains generally coaxially centered with respect to the sprinkler axis X-X from its position in the unactuated state of the sprinkler assembly 10 through the axial displacement of the support subassembly 110 in the actuated state of the sprinkler assembly 10 until the projection member 114 contacts the internal contact surface 26. Upon contact with the internal shelf 26, the ejected support subassembly 110 is pivoted out of supporting contact with the discharge orifice end 106 of the fluid flow tube 104 and pivoted out of the fluid flow path between the outlet opening 24 and the fluid deflection member 30.

Shown in FIGS. 2A-2B, 3 and 4 are detailed partial cross-sectional views of the fluid discharge end 10*b* of the sprinkler assembly 10 showing varying embodiments of the structural and dynamic relationship between the support subassembly 110 and the internal surface of the housing 12. The fluid discharge end 10*b* of the housing 12 preferably includes an externally threaded body 50 with an internal surface that surrounds the sprinkler axis X-X to define a portion of the internal conduit 18. Although the tubular housing 12 can be formed as a single unitary structure, the tubular housing 12 is more preferably a sprinkler frame sub-assembly formed by the interconnection of two or more tubular housing components. For example, in the preferred assembly of FIG. 1, the housing 12 includes another externally threaded tubular component 52 forming the fluid intake end 10*a*, the externally threaded body 50 forming the fluid discharge end 10*b* with an intermediate internally threaded tubular component 54 interconnecting the fluid inlet and discharge end components 50, 52. The components of the housing 12 can be joined by alternate means or configurations provided the assembly provides for the internal conduit 18 and intake and discharge ends 10*a*, 10*b* as described herein.

Referring again to FIGS. 2A and 2B, the threaded body 50 includes an internal surface 60 that extends axially and radially surrounds the sprinkler axis X-X to define an internal radius R of the body 50. For preferred embodiments described herein, the internal radius R can vary about the sprinkler axis X-X or alternately remain constant to facilitate the preferred structural and dynamic relationship between the housing 12 and the support subassembly 110. In the body 50 of FIGS. 2A and 2B, the radius R varies both along the axial length of the internal surface 60 and angularly about the sprinkler axis X-X. As more clearly seen in FIG. 2B a first radius R1 varies to define a recessed region 62 along the inner surface 60 that is contiguous with the internal shelf 26 of the body 50. The first radius R1 preferably decreases in the axial direction so that the recessed region 62 preferably tapers narrowly in the axial direction toward the contact surface 26. Moreover, the first radius R1 preferably decreases in the angular directions about the sprinkler axis X-X away from the deepest portion of the recessed region 62 where R1 is at its maximum. As seen, the recessed region 62 accommodates the projection member 114 of the support subassembly 110 to axially locate the projection member 114 in line with the internal contact surface 26 allowing for the axial translation of the projection member 114 toward the contact surface 26.

Figure 2A:
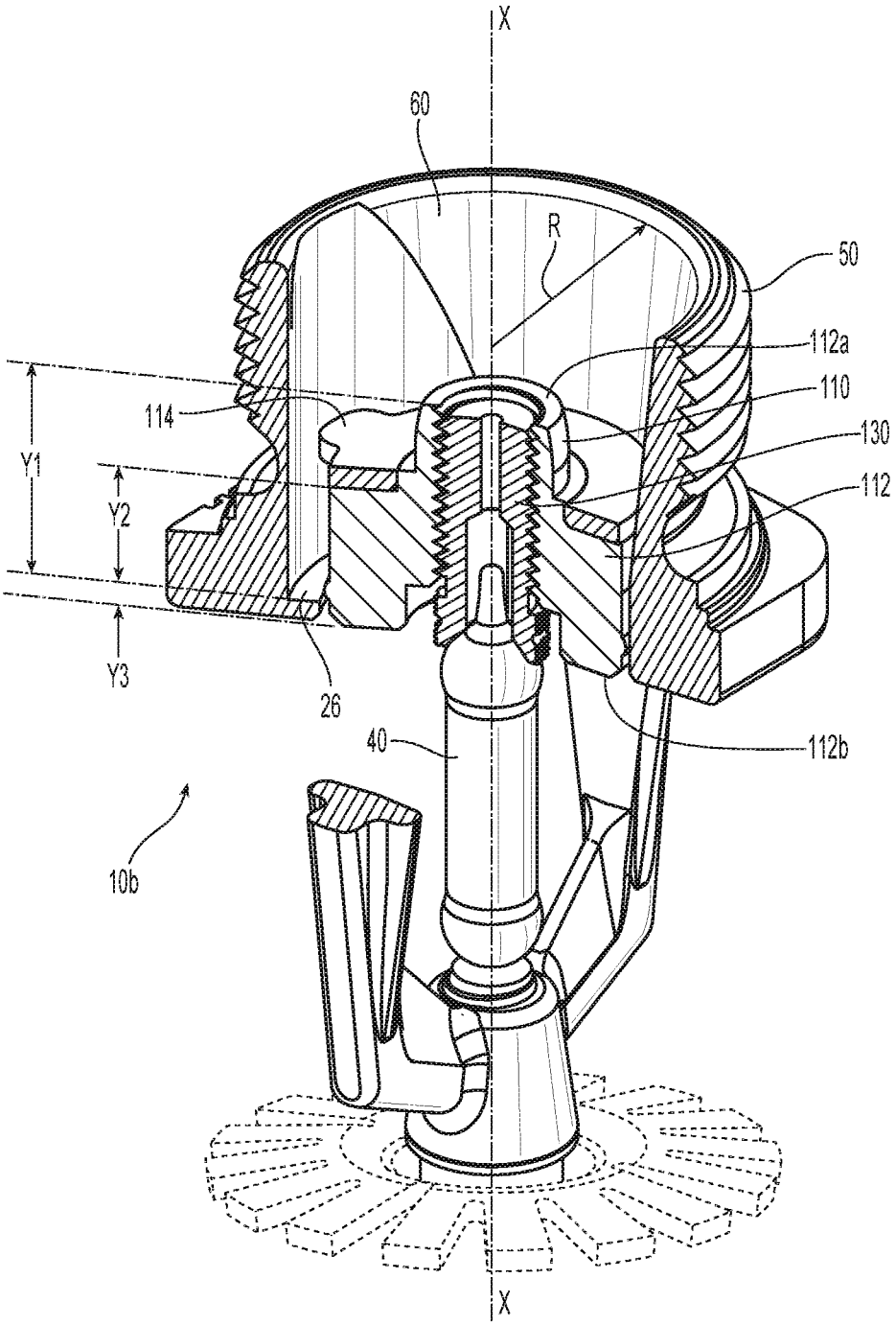
FIG. 2A is a detailed partial cross-sectional view of a preferred embodiment of the sprinkler housing and portion of a fluid control assembly in an unactuated state of the sprinkler for use in the sprinkler assembly of FIG. 1.

FIG. 2A shows the support subassembly 110 and the projection member 114 in its unactuated position spaced from the internal shelf 26 with the discharge orifice end 106 of the fluid flow tube 104 removed for ease of viewing. In a preferred unactuated configuration, the first end 112*a* of the post member 112 is located at a first distance Y1 from the internal contact surface 26 and the projection member 114 is located at a second distance Y2 from the internal contact surface 26 that is preferably over 50% of the first distance Y1, for example, about 75-90% of the first distance Y1, but more preferably just over 50%, for example, in the range from 50-55% of the first distance Y1. In the preferred unactuated state of the sprinkler assembly 10, the second end 112*b* of the post member 112 is located proximate the outlet opening 24 at a distance Y3 from the internal shelf 26 that preferably ranges from 10-25% of the first distance Y1 and more preferably 10-15% of the first distance Y1. Accordingly, in the unactuated state of the sprinkler assembly, the support subassembly 110 is preferably completely disposed in the internal conduit 18 with the second end 112*b* substantially flush with the second end 16 of the outer housing 12 as seen in FIG. 1.

Figure 2B:
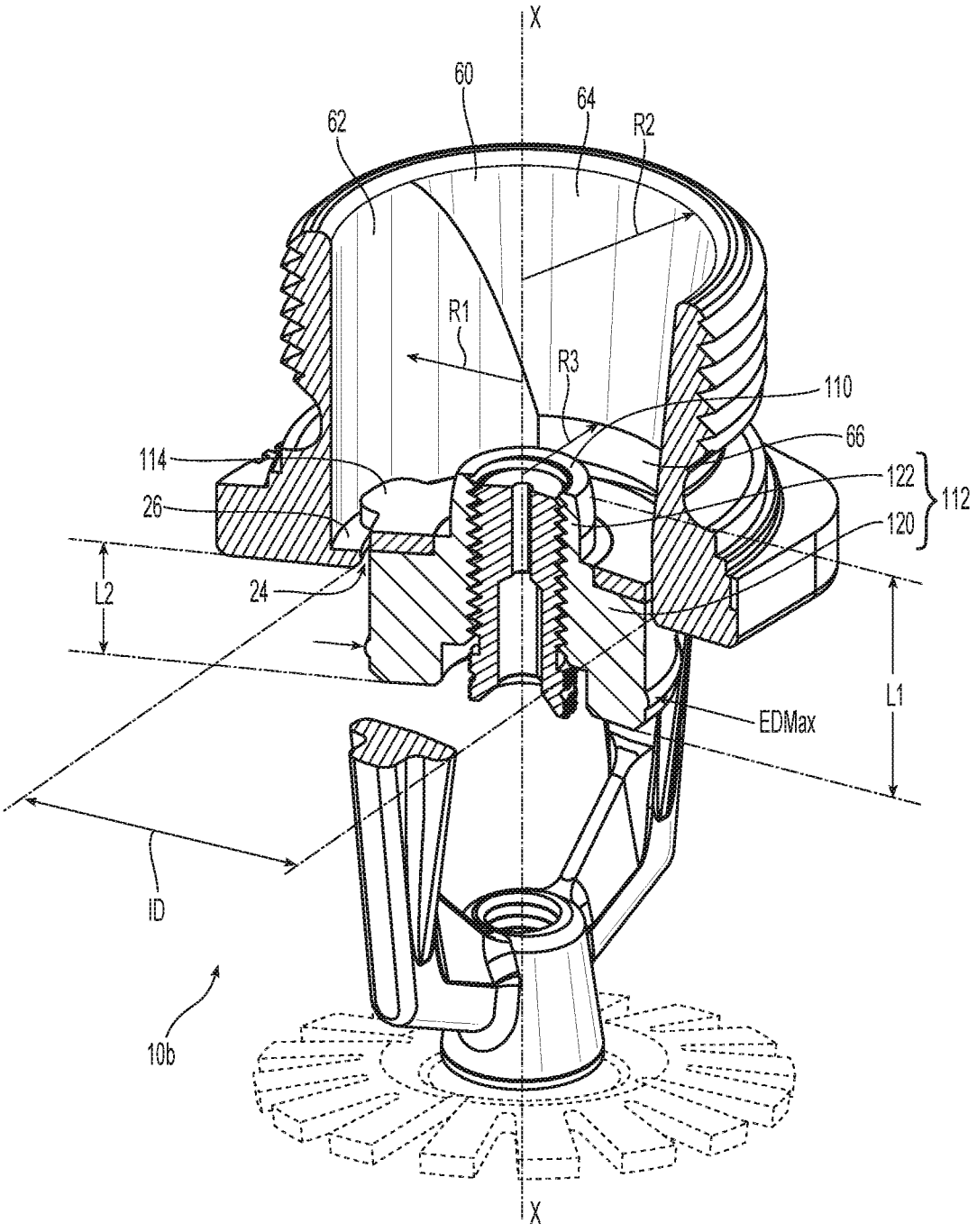
FIG. 2B is a detailed partial cross-sectional view of the assembly of FIG. 2A in an actuated state.

FIG. 2B shows the sprinkler assembly 10 in the actuated state with most of the post member 112 out of the outlet opening 24 and the projection member 114 in contact with the internal shelf 26. The arcuate width of the recessed region 62 about the sprinkler axis X-X accommodates for any rotation of the support subassembly 110 and its projection member 114 about the sprinkler axis X-X over the internal shelf 26. In a preferred aspect, the arcuate width of the recessed region 62 defines a first width and the projection member 114 defines a second width smaller than the first width with the arcuate width of the recessed region 62 being at least two times greater than the width of the projection member 114 so as to permit rotation of the projection member 114 and the support subassembly 110 about the sprinkler axis X-X within the recessed region 62.

Referring again to FIG. 2B, the inner surface 60 preferably defines a second region 64 contiguous with the recessed region 62 that is defined by a second radius R2 that varies at a constant rate preferably in only the axial direction toward the outlet opening 24 to define a partially conical section of the inner surface 60 that tapers narrowly toward the outlet opening 24. The inner surface 60 of the body 50 preferably includes a third region 66 contiguous with each of first and second regions 62, 64 that is defined by a third radius R3 that is preferably constant about the sprinkler axis X-X to define a circular cylindrical inner surface of the body 50.

Figure 3:
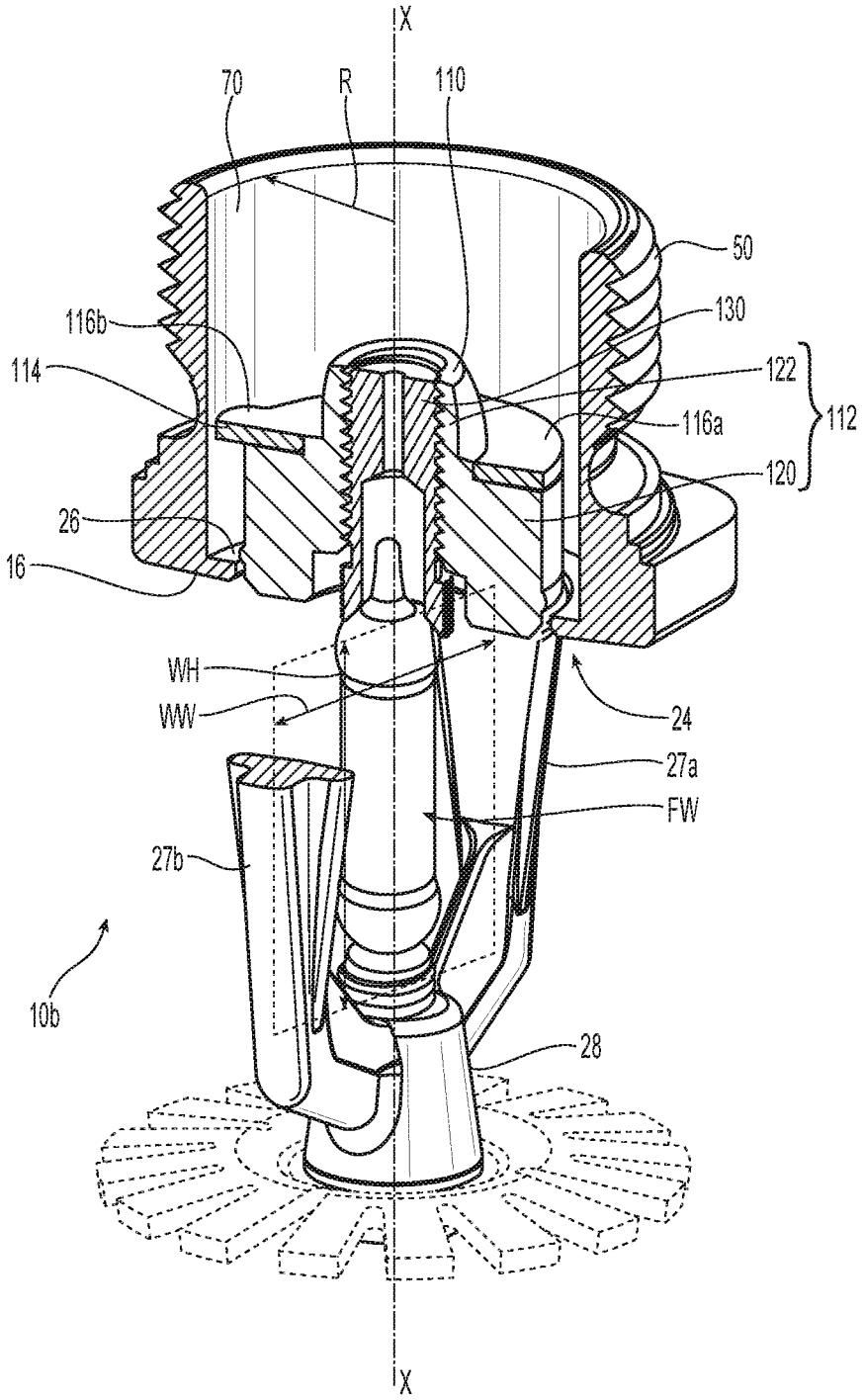
FIG. 3 is a detailed partial cross-sectional view of another preferred embodiment of a sprinkler housing and portion of fluid control assembly in an unactuated state for use in the sprinkler assembly of FIG. 1.

Accordingly, the inner surface 60 of the body 50 can be configured in any manner of ways provided it facilitates and/or permits the dynamic relationship between the projection member 114 of the support subassembly 110 and the internal shelf 26. Shown in FIG. 3 is another embodiment of the body 50 having an alternate configuration of the inner surface 70 in which the internal radius R of the inner surface 70 is constant 360 degrees (360°) about the sprinkler axis X-X and along the axial length of the inner surface to define an annular recess for accommodating the projection member 114. Accordingly, with the internal contact surface or shelf 26 being an annular surface disposed preferably perpendicular to and circumscribed about the sprinkler axis X-X, the internal surface 70 and shelf 26 define a right circular cylindrical internal volume of the body 50. The internal volume defined by the constant radius R of the inner surface 70 accommodates the projection member 114 of the support subassembly 110 three hundred and sixty degrees (360°) about the sprinkler axis X-X to allow for any rotation of the subassembly 110 about the sprinkler axis X-X. Moreover, given that the internal shelf 26 completely circumscribes the sprinkler axis X-X, the projection member 114 of the support subassembly 110 remains axially aligned with the internal shelf 26 in the unactuated state of the sprinkler 10 for contact upon sprinkler actuation.

With reference to FIG. 3, preferred embodiments of the sprinkler housing 12 include a pair of frame arms 27*a*, 27*b* that are diametrically opposed about the outlet opening 24 and extend, preferably axially, away from the second end 16 of the housing 12 along the longitudinal sprinkler axis X-X. In preferred embodiments, the frame arms 27*a*, 27*b* merge to form a frame boss 28 centered about the sprinkler axis X-X. The fluid deflection member 30 is preferably affixed to the frame boss 28 to locate the fluid deflection member 30 at the preferred fixed distance from the outlet opening 24. As shown, the frame boss 28 is preferably substantially frusto-conical in shape but may define alternate geometries, such as for example hemispherical, provided it can support the fluid deflection member 30, trigger 40 or other components of the assembly. In the preferred embodiment of the sprinkler assembly 10, a frame window FW, is formed between the second end 16 of the tubular housing 12, the pair of frame arms 27*a*, 27*b* and the frame boss 28. The frame window FW defines a window height WH preferably measured by an axial distance between the second end 16 of the housing 12 and the frame boss 28 to which the fluid deflection member 30 is affixed. The window FW also defines a window width WW preferably measured by a distance that preferably varies between the frame arms perpendicular to the axial distance.

As part of the preferred structural and dynamic relationship between the ejectable member of the fluid control assembly 100 and the housing 12, the support subassembly 110 has one or more dimensional relationships with the respect to the frame window FW. For example, with reference to FIGS. 2B and 3, the axial length L1 of the support subassembly 110 is less than the window height WH but preferably over 50% of the window height WH, preferably in a range from over 50% to 65% and more preferably in a range over 60% to 65%. Alternate embodiments can provide for the axial length L1 of the support subassembly 110 to be over 65%, for example, about 68-70% of the window height WH. In the preferred actuated state of the sprinkler assembly 10, the support subassembly 110 is located within the frame window FW having a first orientation coaxially aligned with the sprinkler axis and a second orientation skewed with respect the sprinkler axis and out of the frame window FW in which the projection 114 of the subassembly 110 contacts the internal contact surface 26 to alter the support subassembly 110 from the first orientation to the second orientation. Moreover, at the point at which the projection 114 contacts the internal shelf 26, a length L2 of the post member is ejected out of the outlet opening 24. The ejection length L2 of the post member 112 is preferably over 45% and more preferably in the range of 50-55% of the axial length L1 of the entire post member 112.

In another preferred aspect of the preferred structural and dynamic relationship, the axial travel of the projection member 114 to the internal shelf 26 is preferably less than the window height WH to ensure after its initial ejection from the outlet opening 24, the support subassembly 110 begins to pivot before contacting either the frame arms 27*a*, 27*b* or the frame boss 28. Accordingly, the axial travel preferably maintains the support subassembly 110 within a region of the frame window where the window width WW is greater than the width of the post member 112 before pivoting under contact with the internal contact surface 26. In a preferred aspect of the actuated state of the sprinkler assembly 10, over 50% of the axial length of the post member 112 is outside the internal passageway before the projection member 114 contacts the internal contact surface 26 and more preferably 50%-55% of the axial length of the post member is outside the internal passageway before the projection member 114 contacts the internal contact surface 26. In an alternate embodiment, 75%-95% of the axial length of the post member 112 is outside the internal passageway before the projection member 114 contacts the internal contact surface 26. In another preferred aspect, the projection 114 and its point of contact with the internal contact surface 26 are preferably aligned with a plane bisecting the frame window FW so that the support subassembly 110 pivots in the bisecting plane, centered and preferably displaced clear of the frame arms 27*a*, 27*b*, and out of the fluid flow path of the sprinkler assembly 10.

With reference to FIGS. 2B and 3, preferred embodiments of the post member 112 of the support subassembly 110 preferably include a cylindrical body portion 120 having a first diameter and a cylindrical head portion 122 of a second diameter smaller than the first diameter. The diameter of the body portion 120 defines a maximum external diameter EDMax of the post member 112 and is smaller than the internal diameter ID of the outlet opening 24 to define an internal diameter-to-maximum external diameter ratio (ID: EDMax) that ranges from 1.3:1 to 1.1:1 and more preferably ranges from 1.3:1 to 1.2:1. The projection member 114 preferably extends radially from the post member 112. The projection member 114 is preferably a separate component disposed, secured and more preferably interlocked about the head portion 122 of the post member 112. In the preferred embodiments of the support subassembly 110 shown in FIGS. 2A-2B and 3, the preferred projection member 114 includes an annular portion 116*a* that is circumscribed and affixed about the head portion 122 of the post member 112 with a rectilinear portion 116*b* extending radially from the annular portion. Shown in FIG. 4 is another alternate embodiment of the support subassembly 110 in which the projection member 114' includes an arcuate portion 116'*a* that partially circumscribes about the head portion 122 of the post member 112 with the rectilinear portion 116*b* extending radially from the arcuate portion 116'*a*.

Figure 4:
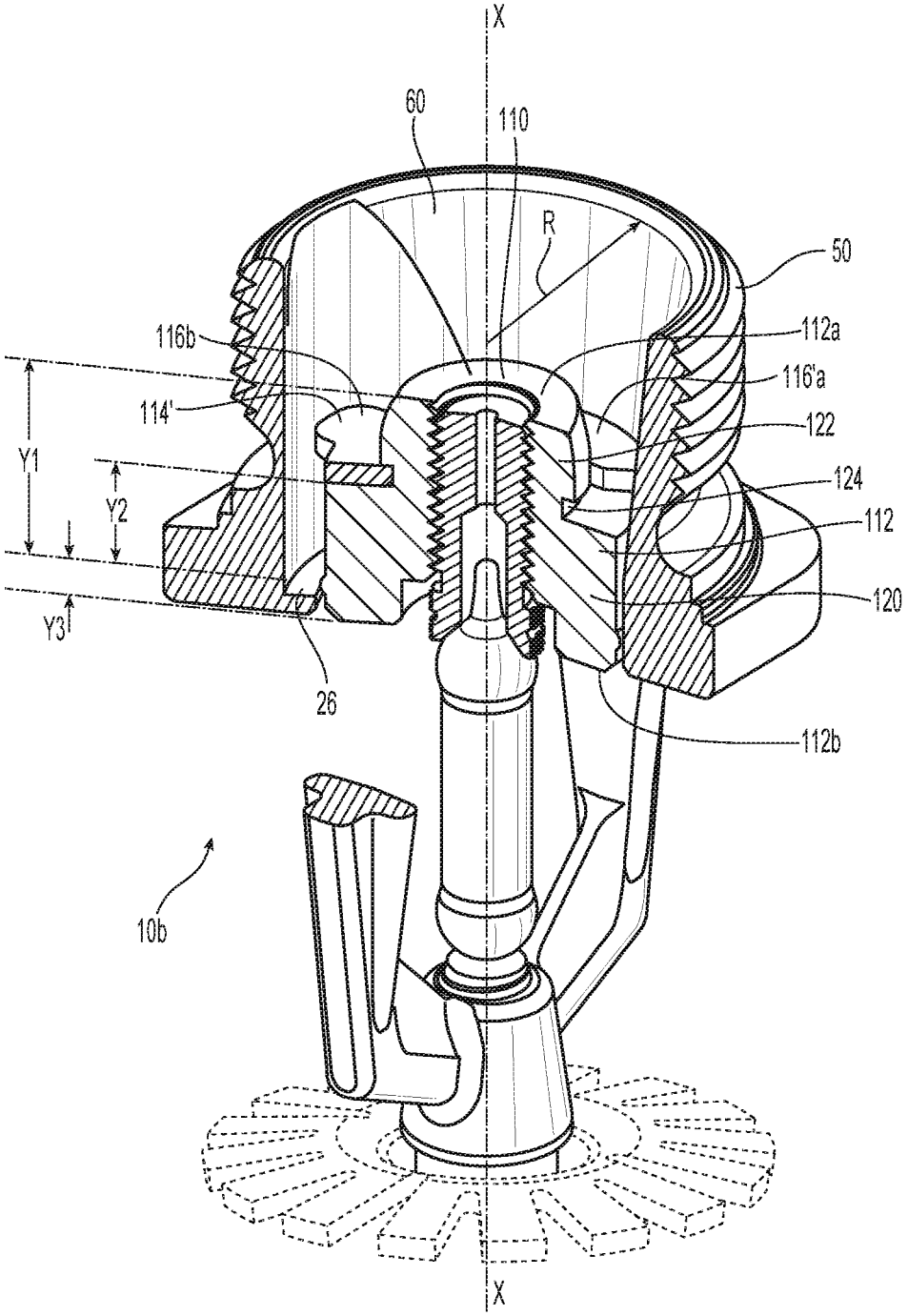
FIG. 4 is a detailed partial cross-sectional view of yet another preferred embodiment of a sprinkler housing and portion of fluid control assembly in an unactuated state for use in the sprinkler assembly of FIG. 1.
Figure 4A:
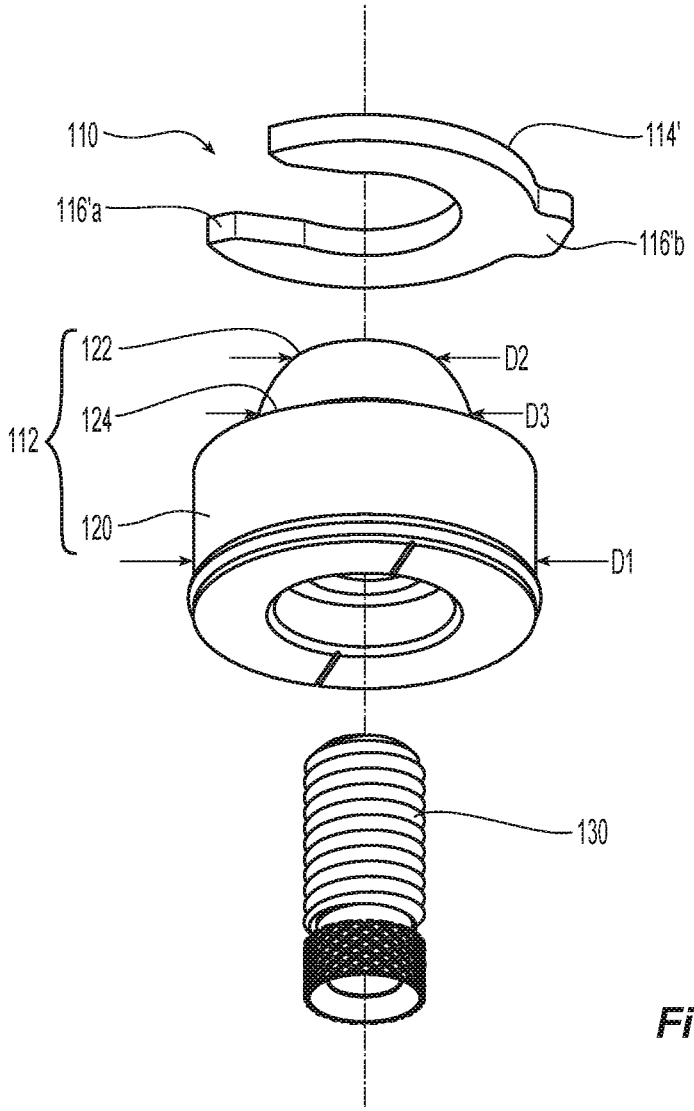
FIG. 4A is an exploded perspective view of a preferred embodiment of a support subassembly for use in the sprinkler assembly of FIG. 1.
Figure 4B:
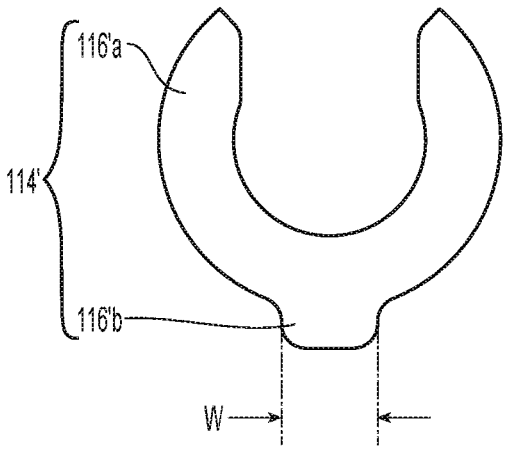
FIG. 4B is a plan view of a preferred embodiment of a projection member for use in the support subassembly of FIG. 4A.

Shown respectively in FIGS. 4A and 4B are an exploded view of the preferred support subassembly 110 and a plan view the projection member 114' of FIG. 4 for use in the flow control assembly 100. The post member 112 preferably includes a cylindrical body portion 120 having a first diameter D1 and a cylindrical head portion 122 of a second diameter D2 smaller than the first diameter with a neck portion 124 formed between the body and head portions 120, 122 having a third diameter D3 less than the first diameter D1 and greater than the second diameter D2. Alternatively, the diameters post member 112 can be equal to one another or vary from one another in any manner provided the post member 112 provides for the support and ejection of the support subassembly 110 in a manner as described herein. For example, in another preferred embodiment, the neck portion 124 can have a diameter D3 that less than both the first and second diameters D1, D2. The body portion 120 is preferably a right circular cylinder but can define alternate geometries. For example, a preferred embodiment of the body portion can include a chamfer or weighted portion which can offset the center of gravity of the post member from the sprinkler axis X-X.

The arcuate portion 116*a* is affixed about the neck portion 124 of the post member 120 in a preferred press-fit engagement. The preferred press-fit engagement of the projection member 114 about the post member 112 can be permanent or configured for multiple use or repeated engagement. Moreover, although the embodiments shown include a single necked portion about which the projection member 114 is engaged, the post member 112 can include multiple areas of reduced diameter about which the projection member 114 can be selectively engaged. Selectively affixing the projection member 114 about the post member 112 can provide for adjustably locating the projection member 112 along the axial length of the post member 112 to define the timing of the contact between the projection member and the internal shelf 26 of the housing 12. The selective adjustment can further define the structural and dynamic relationship between the ejectable support subassembly 110 and the housing 12. An adjustable affixation can provide a mechanism for changing the projection member 114 to provide a support subassembly 110 with variable projection members to ensure the best fit within the housing 12 and engagement with the internal shelf 26.

Preferred embodiments of the support subassembly 110 further includes a pip cap 130 centered within the cylindrical body 120 to support or seat the thermally responsive trigger 40 in the unactuated state of the sprinkler assembly where the trigger 40 is embodied as a thermally responsive glass bulb trigger as seen for example in FIG. 2A. The glass bulb 40 fractures at a nominal operating temperature and with a thermal sensitivity to define the thermal responsiveness of the sprinkler at which the sprinkler actuates in response to a fire. In the unactuated state of the sprinkler assembly 10, the post member 112 and the pip cap 130 together fill and conceal the outlet opening 24 of the housing 12. Moreover, the glass bulb trigger 40 is seated preferably at a fixed distance from the outlet opening 24 as shown in FIG. 1 to transfer a compressive load to the fluid control assembly 100 and form the sealed engagement at the internal sealing surface 22. In the preferred embodiment, the frangible glass bulb 40 has one end preferably seated at or proximate the frame boss 28 under load from a screw member 42 threadedly engaged with the frame boss 28.

Figure 5:
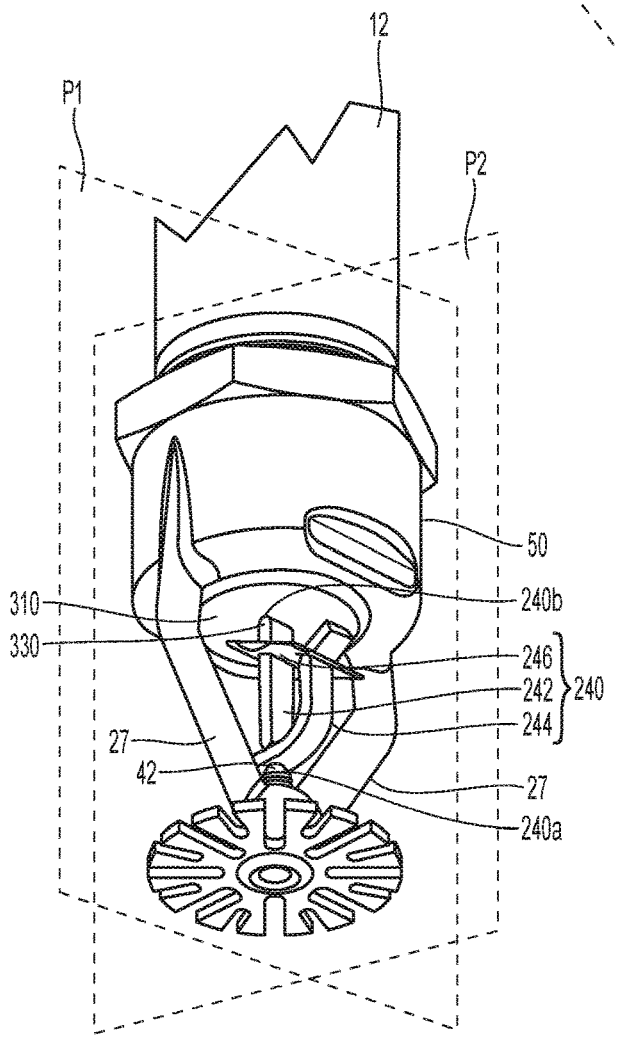
FIG. 5 is a perspective view of another embodiment of a dry sprinkler assembly with an alternative thermally responsive trigger.

Alternatively, the trigger 40 can be configured as a soldered mechanical assembly 240 seated proximate the frame boss 28 as seen, for example, in FIG. 5. The soldered mechanical assembly 240 includes a strut member 242 and a lever member 244 held together by a link assembly 246 held together by thermally responsive solder material. The soldered mechanical assembly 240 can be configured similarly to the trigger used in the dry sprinkler shown and described in U.S. Pat. No. 7,766,252. As seen, the assembly 240 has a first end 240*a* seated against the load screw member 42 and a second end 240*b* seated against the support subassembly 310. In the embodiment shown, the trigger assembly 240 extends out of the plane P1 and more preferably extends along a second perpendicular plane P2 that bisects the frame window FW between frame arms 27.

Figure 6A:
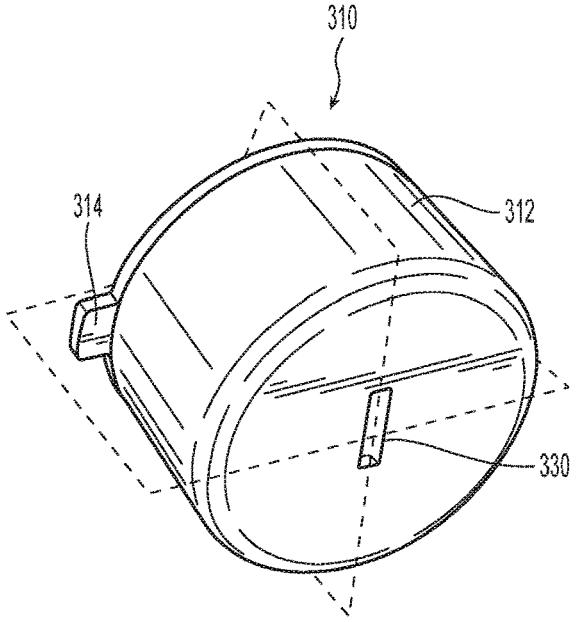
FIG. 6A is a perspective view of another embodiment of a support subassembly for use in the sprinkler assembly of FIG. 5.
Figure 6B:
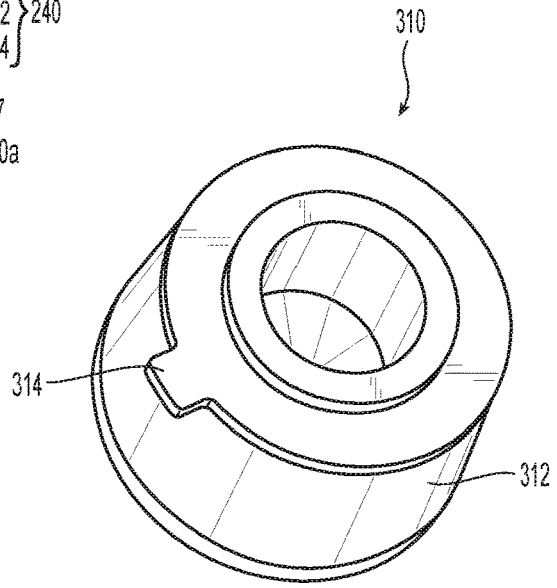
FIG. 6B is another perspective view of the support subassembly of FIG. 6A.

Shown in FIGS. 6A and 6B is an alternative preferred embodiment of the support subassembly 310 which includes a post member 312 with a projection member 314 affixed about the post member 312. The projection member 314 and the post member 312 are preferably interlocked with one another in a manner as previously described. The post member 312 preferably includes a formation that preferably serves as an orientation indicator 330. In a preferred embodiment, the orientation indicator is an elongated groove or slot 330 disposed on the exposed end of the post member 312 so as to be external of the housing 12 and visible. The projection member 314 preferably extends radially from the post member 312 in a direction perpendicular to the direction of elongation of slot 330. Accordingly, the elongated slot 330 can indicate the orientation of the projection member 314 within the housing 12 of the sprinkler assembly depending upon the orientation of the slot 330 and thus, define a preferred structural and dynamic relationship between the ejectable support subassembly 310 and the housing 12. By orienting the elongated slot 330 in the plane P1 of the frame arms 27, the projection member 314 is preferably aligned along the bisecting plane P2 to ensure that the support subassembly pivots in the plane between the frame arms 27 clear of the sprinkler frame components. The elongated groove 330 is preferably centrally formed on the post member 312 and thus also preferably serves as a seat for the preferred soldered mechanical trigger assembly 240.

The orientation indicator 330 can be alternatively configured so long as the indicator is located with a known relation to the projection member 314 and remains visible external to the housing 312. For example, the indicator can be multiple visible linearly spaced dent formations on the exposed end of the post member 312 that are off center and extend perpendicular to the radial direction of the projection member 314. In alternate embodiments, the slot 330 or other orientation indicator can be configured for use with a frangible glass bulb type trigger 40 to indicate the orientation of the projection member. Moreover, sprinkler assembly embodiments having a preferred ejectable subassembly with projection member that incorporates either or both of the orientation indicator and/or the soldered trigger 40 can be used in a vacuum dry sprinkler system or other types of fire protection sprinkler systems configured as either a wet automatic fire protection sprinkler system or a dry pipe automatic fire protection sprinkler system.

Figure 6C:
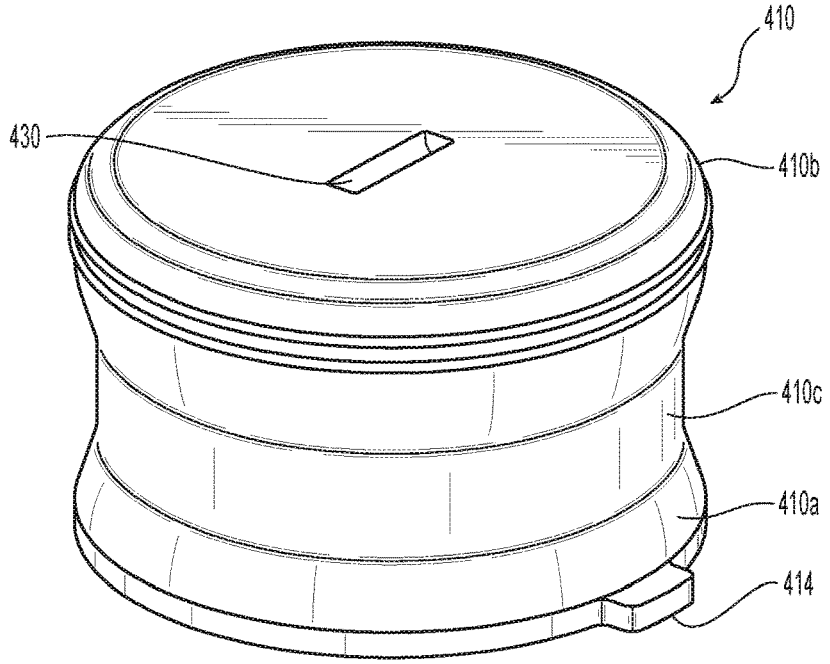
FIG. 6C is a perspective view of another embodiment of a support subassembly for use in the sprinkler assembly of FIG. 5.
Figure 6D:
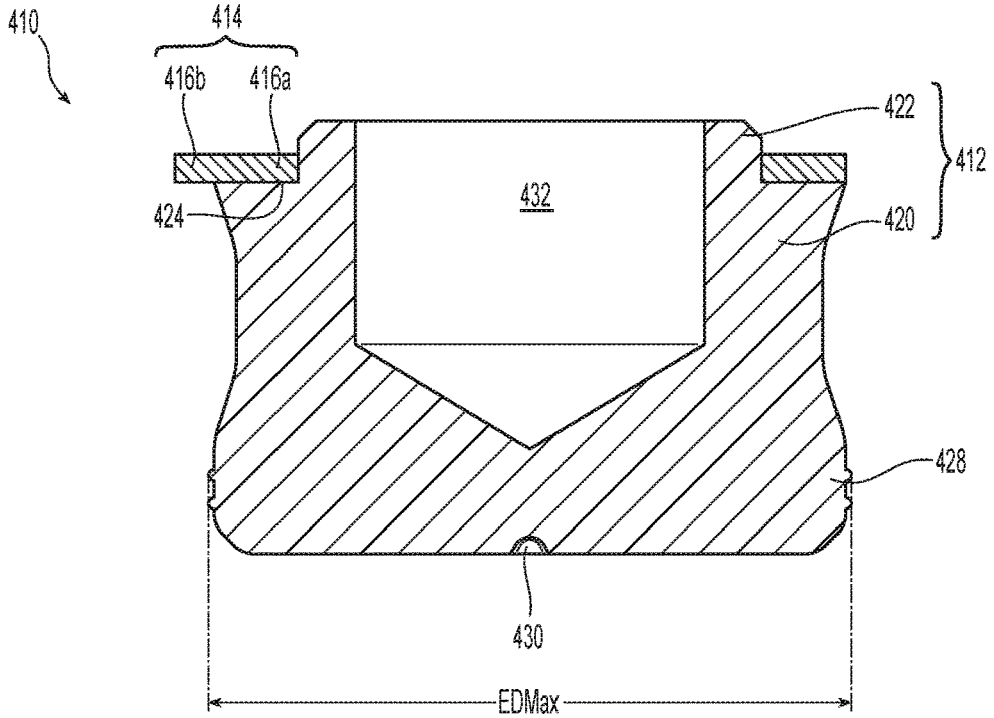
FIG. 6D is another perspective view of the support subassembly of FIG. 6C.

Shown in FIGS. 6C and 6D is another alternate embodiment of the support subassembly 410 having a post member 412 with a projection member 414 affixed about the post member 412. The preferred support subassembly 410 has a preferred geometry for supporting the fluid flow tube 104 in the unactuated state of the sprinkler assembly and for facilitating the preferred dynamic relationship between the support subassembly 410 and the sprinkler housing that provides proper and complete ejection of the support subassembly 410. Generally, the support subassembly 410 preferably includes a first end region 410*a* proximate the projection member 414, a second end region 410*b* proximate the end face for seating against the thermally responsive trigger 40 and a third mid-region 410*c* between the first and second end regions 410*a*, 410*b* that is narrower than the first and second end regions 410*a*, 410*b*. More specifically, each of the first end region 410*a*, second end region 410*b* and third mid-region 410*c* define a respective width or diameter of the support subassembly 410 that extends transverse to the height of the support subassembly 410. In the preferred support subassembly 410, the third mid-region 410*c* defines a width that is smaller than the widths defined by each of the first end region 410*a* and the second end region 410*b*. In the sprinkler assembly, the first end region 410*a* of the support subassembly 110 is dimensioned to support the internal fluid flow tube 104, and the second end region 410*b* of the support subassembly 110 is dimensioned to conceal the outlet opening 24 in the preferred manner as described herein. The preferably narrower third mid-region 410*c* is dimensioned to avoid any lodgment and facilitate the ejection of the support subassembly 410 out of the outlet opening 24 of the sprinkler assembly.

With reference to FIG. 6D, the post member 412 includes a reduced head portion 422 formed at one end of the body portion 420; and the projection member 414 preferably includes an annular portion 416*a* interlocked about the reduced head portion 422 of the body portion 420. The body portion 420 forms an intermediate annular shelf or shoulder 424 with the head portion 422 on which the projection member 414 and its annular portion 416*a* rests. Axially spaced from the shoulder 424 is a region 428 of the body 420, preferably proximate the exposed end of the body 420 opposite the head portion 422, that defines the maximum external diameter EDMax of the body 420 to define the maximum diameter of the body portion 420 for concealing the outlet opening 24 of the housing 12. The shoulder 424 is preferably of an equivalent or larger diameter to support the projection member 414 and the internal fluid flow tube 104. The mid-region of the body portion 420 has a reduced diameter to create sufficient space between the body 420 and the internal surface of the outlet opening 24 to avoid lodgment issues.

As shown, the exposed end of the body 420 includes a slot 430 for seating against a solder mechanical link trigger assembly. In the embodiment shown, the body 420 includes a central blind bore 432 that initiates through the head portion 422. In an alternate embodiment, the support subassembly 410 can be alternatively configured for seating against a glass bulb trigger with a central pip cap extending through the body 420 of the post member 412.

With reference to FIG. 1, the remaining components of the preferred fluid control assembly 100, including the seal subassembly 102 and the fluid flow tube 104 can each be configured and assembled using multiple components. For example, the seal subassembly 102 preferably includes a spring disc 101 affixed about a base 103 having an array of legs 103*a* extending therefrom. In the unactuated state of the sprinkler assembly, the spring disc 101 forms the fluid-tight sealed contact with the internal seal surface 22 of the housing. The seal subassembly 102 can be configured as any one of the embodiments of "spring support assembly" shown and described in the dry sprinkler assembly of U.S. Pat. No. 8,636,075.

The fluid flow tube 104 of the fluid control assembly 100 can include a first tubular member 104*a* having a flared inlet end for receipt of the seal subassembly 102 in an abutting engagement with the rest of the first tubular member 104*a* being of constant diameter for abutting a second tapering tubular member 104*b* that defines the discharge orifice 106 of the sprinkler assembly 10. The supporting subassembly 110 is preferably received within the discharge orifice 106 in an abutting engagement. The first tubular member 104*a* is preferably biased in a direction toward the second tapering tubular member 104*b* by an internal spring member 105 disposed about the first tubular member 104*a*. Accordingly, the internal spring member 105 biases the fluid control assembly 100 toward the outlet opening 24 and out of contact with the internal sealing surface 22. The first and second tubular members 104*a*, 104*b* of the fluid flow tube 104 can be respectively configured as the tubular and orifice members shown and described in U.S. Pat. No. 8,636,075.

In the actuated and open state of the sprinkler assembly 10, the fluid flow tube translates to locate the discharge orifice 106 at the fluid discharge end 10*b* of the housing 12 proximate the outlet opening 24. Fluid flowing through the inlet opening 20 flows at a preferred operating pressure, through the fluid flow tube 100*b*, out the discharge orifice 106 and the outlet opening 24 to impact the axially spaced fluid deflection member 30. The discharge orifice 106 is preferably configured and dimensioned to define the desired discharge characteristics of the sprinkler. Accordingly, the discharge orifice 106 can be quantified by a preferred nominal K-factor. The discharge or flow characteristics from the sprinkler body is defined by the internal geometry of the sprinkler including its internal passageway, inlet and outlet (the orifice). As is known in the art, the K-factor of a sprinkler is defined as $K=Q/P^{1/2}$, where Q represents the flow rate (in gallons/min GPM) of water from the outlet (the orifice) of the internal passage through the sprinkler body and P represents the pressure (in pounds per square inch (psi.)) of water or firefighting fluid fed into the inlet end of the internal passageway through the sprinkler body. Generally, the discharge characteristics of the sprinkler body define a preferred nominal K-factor in a range of 11 [GPM/(psi)$^{1/2}$] to 50 [GPM/(psi)$^{1/2}$]. Preferred embodiments of the sprinkler assembly 10 defines a nominal K-factor which range from 4.2 [GPM/(psi)$^{1/2}$] to 14.0 [GPM/(psi)$^{1/2}$] but can be alternatively smaller or larger, for example, any one of a nominal 16.8 [GPM/(psi)$^{1/2}$]; 19.6 [GPM/(psi)$^{1/2}$]; 22.4 [GPM/(psi)$^{1/2}$], 25.2 [GPM/(psi)$^{1/2}$], 28.0 [GPM/(psi)$^{1/2}$] or 33.6 [GPM/(psi)$^{1/2}$], depending upon the application. In sprinkler assemblies having a large orifice, e.g., over 19.6 [GPM/(psi)$^{1/2}$] such as for example, 22.4 [GPM/(psi)$^{1/2}$], 25.2 [GPM/(psi)$^{1/2}$], 28.0 [GPM/(psi)$^{1/2}$] or 33.6 [GPM/(psi)$^{1/2}$], the support subassembly is preferably configured as the subassembly 410 as shown in FIGS. 6C and 6D. Accordingly, in a sprinkler assembly 10 having a discharge orifice 106 defined by nominal K-factor of 22.4 [GPM/(psi)$^{1/2}$] or greater, the fluid flow tube 104 is preferably supported by a support subassembly 410 having the preferred first end region 410*a* sized to support the discharge orifice end 106, an opposite second end region 410*b* to fill and conceal the outlet opening 24 of the sprinkler housing 12 and a mid-region 410*c* that is narrower than its end regions 410*a*, 410*b* to facilitate proper ejection out of the outlet 24 and the fluid flow path of the sprinkler assembly.

Figure 7:
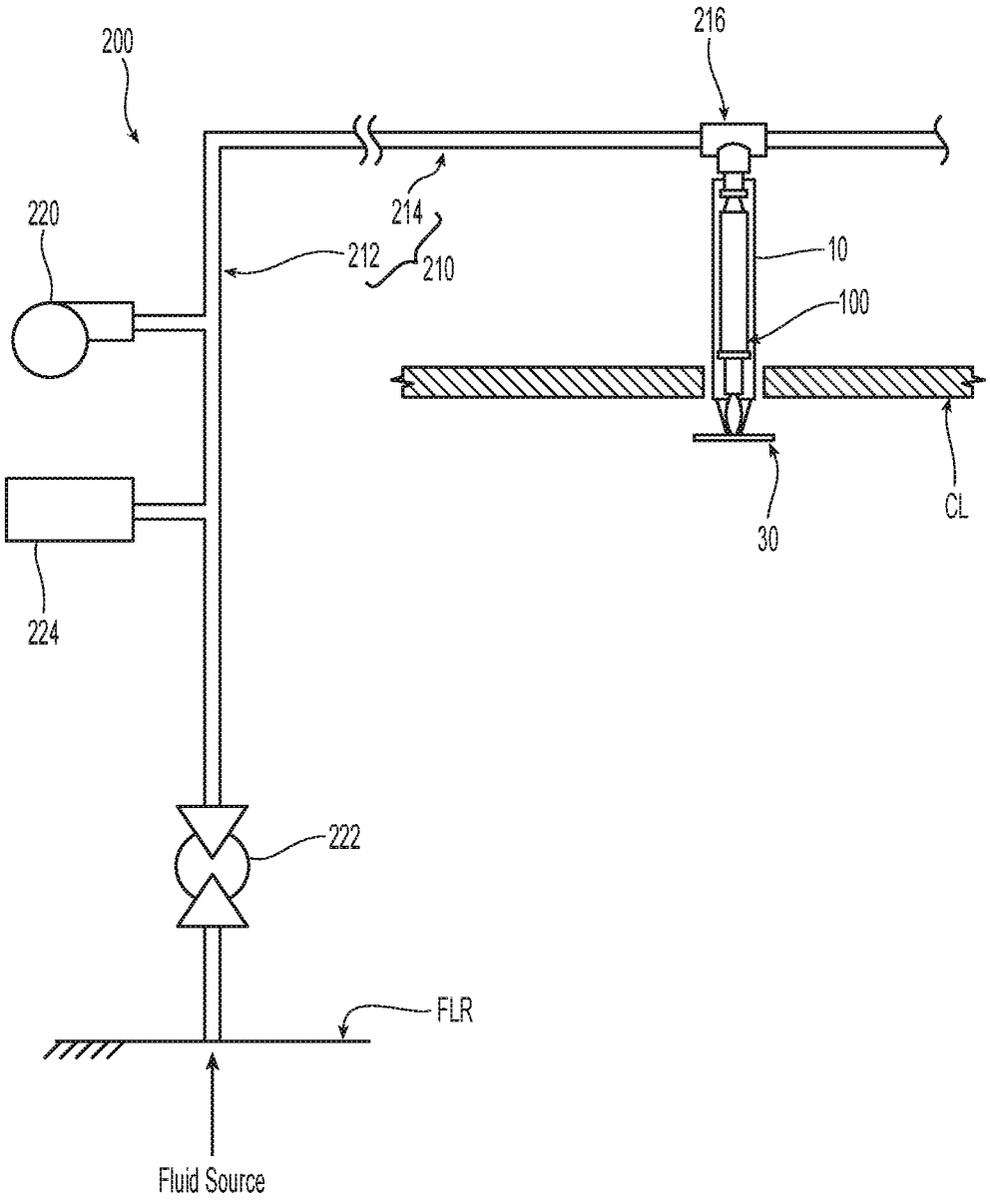
FIG. 7 is a schematic view of a preferred embodiment of a vacuum dry fire protection system using a dry sprinkler assembly of any one of FIGS. 1-6D.

FIG. 7 schematically shows a preferred dry vacuum sprinkler system 200 using a preferred embodiment of dry sprinkler assembly 10 as described herein. A preferred embodiment of the system 200 includes a network of pipes 210 that includes a fluid supply riser 212 and at least one branch pipe 214 coupled to the fluid supply riser by one or more cross-mains. As shown, the preferred dry fire protection sprinkler 10 is coupled to the branch pipe by an appropriate fitting, such as for example, a tee-fitting 216. A vacuum pressure source 220 is coupled to the network of pipes 210 to apply a negative pressure to the piping network 210 and the connected fire protection sprinklers. A fluid control valve 222 is preferably coupled to the riser to control the delivery of firefighting fluid from a fluid source. A controller 224 is preferably in communication with the network of pipes 210, system fluid control valve and vacuum source to control the actuation of the system 200.

As shown in FIG. 1, the fluid deflection member 30 coupled to the frame boss is a pendent type fluid deflection member 30 configured for installation in a pendent orientation in which water is discharged from the outlet opening 24 in a vertical direction ceiling CL-to-floor FLR to impact the fluid deflection member 30. In the dry vacuum fire protection system pendent installation, the sprinkler 10 is coupled to extend vertically from an overhead fluid supply pipe subject to a vacuum pressure. The sprinkler assembly 10 is preferably rotationally oriented with the frame arms 27*a*, 27*b* in line with the supply pipe.

Upon sprinkler actuation, the preferred support subassembly 110 is ejected vertically with respect to the overhead supply pipe and the seal subassembly 102 and fluid flow tube 104 translate vertically toward the outlet opening 24. Upon contact between the projection member 114 and the internal contact surface 26, the support subassembly 110 pivots between the frame arms to escape any vacuum pressure within the housing 12 and rotates clear of any sprinkler structure to avoid any lodgment of the support subassembly 110. With the support subassembly 110 ejected clear of the sprinkler assembly 10, the inlet opening 20 and the discharge orifice are fully open and the fluid flow path are clear for flow of firefighting fluid therethrough to impact the pendent fluid deflection member 30. In an alternate embodiment of the sprinkler assembly 10, the fluid deflection member 30 coupled to the frame boss can be a horizontal type fluid deflection member 30 configured for installation in a horizontal orientation in which water is discharged from the outlet opening 24 in a direction parallel to the ceiling and floor to impact the horizontal fluid deflection member 30. In the dry vacuum fire protection system horizontal installation, the sprinkler 10 is coupled to a fluid supply pipe subject to a vacuum pressure with the sprinkler extending parallel to the floor. The sprinkler assembly 10 is preferably rotationally oriented with the frame arms 27*a*, 27*b* aligned in a plane parallel to the floor. Upon sprinkler actuation, the preferred support subassembly 110 is ejected horizontally parallel to the floor FLR and the seal subassembly 102 and fluid flow tube 104 translate horizontally toward the outlet opening 24. Upon contact between the projection member 114 and the internal contact surface 26, the support subassembly 110 pivots between the frame arms preferably in a plane perpendicular to the floor to escape any vacuum pressure within the housing 12 and clear of any sprinkler structure to avoid any lodgment of the support subassembly 110. With the support subassembly 110 ejected clear of the sprinkler assembly 10, the inlet opening 20 and the discharge orifice are fully open and the fluid flow path are clear for flow of firefighting fluid therethrough to impact the horizontal fluid deflection member 30.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. An automatic dry sprinkler assembly comprising:

a tubular outer housing having a first end and a second end opposite the first end with an internal conduit extending from the first end to the second end along a longitudinal sprinkler axis, the first end defining a fluid intake end of the sprinkler assembly having an inlet opening and an internal sealing surface proximate the inlet opening, the second end defining a fluid discharge end of the sprinkler assembly having an outlet opening and an internal shelf formed about the outlet opening;

a fluid deflection member affixed to the tubular housing at a fixed distance from the outlet opening along a fluid flow path therebetween;

a thermally responsive trigger seated at a fixed distance from the outlet opening between the fluid deflection member and the outlet opening to define an unactuated state of the sprinkler assembly, the thermal response of the trigger defining an actuated state of the sprinkler assembly; and a fluid control assembly disposed coaxially within the internal conduit of the outer housing for axial translation in the thermal response from the unactuated state to the actuated state of the sprinkler assembly, the fluid control assembly including:

a seal subassembly;

a fluid flow tube abutting the seal subassembly; and an ejectable support subassembly abutting the fluid flow tube and seated against the thermally responsive trigger in the unactuated state of the sprinkler assembly to locate the fluid control assembly within the housing such that the seal subassembly is in a fluid-tight sealed engagement with the internal sealing surface of the housing, the support subassembly having a first end proximate the fluid flow tube and a second end axially spaced from the first end and proximate the outlet opening and seated against the thermally responsive trigger, the support subassembly including a projection member located between the first and second ends of the support subassembly to define an axial spacing between the projection member and the internal shelf;

wherein the support subassembly includes a post member with the projection member being located and interlocked about the post member, the post member including a cylindrical body of a first diameter, a head portion of a second diameter smaller than the first diameter, and a neck portion between the body and head portion having a third diameter less that the first diameter.

2. The assembly of claim 1, wherein the first end of the support subassembly is located at a first distance from the internal shelf such that the axial spacing between the projection member and the internal shelf defines a second distance from the internal shelf surface that is less than the first distance, the second distance being over 50% of the first distance.

3. The assembly of claim 1, wherein in the actuated state, the support subassembly is ejected through the outlet opening with the support subassembly being coaxially aligned along the sprinkler axis until the projection member contacts the internal shelf.

4. The assembly of claim 1, wherein the second end of the housing includes an inner surface contiguous with the internal shelf, the inner surface defining an internal radius from the sprinkler axis and an axial length in the direction of the sprinkler axis to define a portion of the internal conduit.

5. The assembly of claim 4, wherein the internal radius varies about the sprinkler axis and along the axial length of the inner surface to define a recessed region along the inner surface, the projection member of the support subassembly being disposed in the recessed region.

6. The assembly of claim 1, further comprising an internal spring disposed about the fluid control assembly to bias the fluid control assembly toward the outlet opening.

7. The assembly of claim 1, wherein the projection member is interlocked about the post member in a press-fit engagement.

8. The assembly of claim 1, wherein the projection member includes an annular portion interlocked and circumscribed about the head portion.

9. The assembly of claim 1, wherein the projection member includes an arcuate portion interlocked and partially circumscribed about the neck portion.

10. The assembly of claim 1, wherein the thermally responsive trigger comprises a frangible glass bulb and the support subassembly includes a pip cap centrally disposed in the post member to support the glass bulb.

11. The assembly of claim 1, wherein the thermally responsive trigger includes a soldered link assembly, the post member including a central slot for supporting the soldered link assembly, the central slot extending perpendicular to the projection member to visually identify the orientation of the projection member within the housing.

12. The assembly of claim 1, wherein the fluid flow tube includes a discharge orifice end and the ejectable support subassembly has a first end region abutting the discharge orifice end, a second end region seated against the thermally responsive trigger and a third mid -region between the first end region and the second end region, the ejectable support subassembly defining a height with the first end region defining a first width transverse to the height, the second end region defining a second width transverse to the height, and the third mid-region defining a third width transverse to the height, the third width of the third mid-region being smaller than the first width of the first end region and the second width of the second end regional.

13. The assembly of claim 1, further comprising a pair of frame arms diametrically opposed about the outlet opening and extending axially; a frame window formed between the second end of the tubular housing, the pair of frame arms and the fluid deflection member, the support subassembly including an indicator formation to orient the projection member along a plane that is perpendicular to and bisects the frame window, the support subassembly being located within the frame window in the actuated state of the sprinkler with the support subassembly having a first orientation coaxially aligned with the sprinkler axis and a second orientation skewed with respect the sprinkler axis out of the window frame, the projection member contacting the internal shelf to alter the support subassembly from the first orientation to the second orientation.

14. The assembly of claim 1, wherein the first end and the second end of the support subassembly are spaced apart to define an axial length of the support subassembly, wherein in the actuated state of the sprinkler, the projection member contacts the internal shelf such that over 50% of the axial length of the support subassembly is ejected outside the internal conduit through the outlet opening.

15. The assembly of claim 1, wherein the outlet opening defines an internal diameter and the support subassembly defines a maximum external diameter that is smaller than the internal diameter of the outlet opening to define an internal diameter-to-maximum external diameter ratio (ID:EDMax) that ranges from 1.3:1 to 1.2:1.

16. A method of actuating an automatic dry sprinkler, the sprinkler having an outer housing with an internal conduit extending along a sprinkler axis, a thermally responsive trigger defining an unactuated state and an actuated state and an internal fluid control assembly having an ejectable support subassembly seated against the trigger to support the internal fluid control assembly within the internal conduit in the unactuated state of the trigger, the method comprising:

locating a projection member of the ejectable support subassembly at an overlapping axially spaced distance from an internal shelf of the outer housing in the unactuated state of the trigger; and contacting the projection member with the internal shelf of the housing in the actuated state of the trigger;

wherein the outer housing includes a fluid inlet with an internal sealing surface and the fluid control assembly includes a seal subassembly and a fluid flow tube abutting the seal subassembly with a first end of the ejectable subassembly abutting the fluid flow tube, wherein the locating the projection member in the unactuated state of the trigger places the seal subassembly in a fluid-tight sealed engagement with the internal sealing surface; and wherein the contacting the projection member with the internal shelf in the actuated state of the trigger includes altering the ejectable support subassembly from a first orientation out of the internal conduit coaxially and aligned with the sprinkler axis to a second orientation skewed with respect the sprinkler axis.

17. The method of claim 16, wherein locating the projection member in the unactuated state of the trigger includes locating the first end of the ejectable subassembly at a first distance with the from the internal shelf and with the axially spaced distance of the projection member from the internal shelf being a second distance, the second distance being over 50% of the first distance.

18. The method of claim 16, wherein the contacting the projection member contact with the internal shelf of the housing in the actuated state of the trigger includes placing the seal subassembly out of sealed engagement with the internal sealing surface.

19. The method of claim 16, wherein the ejectable subassembly has an axial length and wherein the contacting the projection member with the internal shelf in the actuated state of the trigger includes ejecting over 50% of the axial length of the ejectable subassembly out of the internal conduit.

20. The method of claim 16, further includes placing the internal conduit in fluid communication with a vacuum.

21. The method of claim 16, wherein locating the projection member includes interlocking the projection member about a post member of the ejectable subassembly, the post member having a cylindrical body of a first diameter, a cylindrical head portion of a second diameter smaller than the first diameter, and a neck portion having a third diameter less than the first diameter with the projection member including an arcuate portion interlocked and partially circumscribed about the neck portion of the post member in a press-fit engagement, the projection member having a rectilinear portion extending radially from the arcuate portion.

22. The method of claim 16, wherein the locating the projection member includes interlocking the projection member about a post member of the ejectable subassembly, the post member having a body portion and a head portion with the projection member having an annular portion interlocked and circumscribed about the head portion of the post member and a rectilinear portion extending radially from the annular portion.

23. The method of claim 16, wherein the locating the projection member in the unactuated state of the trigger includes disposing the projection member in a recessed region of the internal conduit defined by a portion of an inner surface of the outer housing having a varying internal radius about the sprinkler axis.

24. The method of claim 16, wherein the locating the projection member in the unactuated state of the trigger includes disposing the projection member in an annular recess of the internal conduit defined by a portion of an inner surface of the outer housing having a constant internal radius about the sprinkler axis.

25. The method of claim 16, wherein the locating the projection member in the unactuated state of the trigger includes locating an orientation indicator on the ejectable support subassembly to identify the orientation of the projection member within the housing.

* * * * *